US006964601B2

(12) United States Patent
Petroski et al.

(10) Patent No.: US 6,964,601 B2
(45) Date of Patent: Nov. 15, 2005

(54) METHOD FOR SECURING A POLISHING PAD TO A PLATEN FOR USE IN CHEMICAL-MECHANICAL POLISHING OF WAFERS

(75) Inventors: Angela Petroski, Crawfordsville, IN (US); Richard D. Cooper, Williston Pk, NY (US); Paul Fathauer, Sullivan, IN (US); David Perry, Crawfordsville, IN (US); James Macey, Crawfordsville, IN (US)

(73) Assignee: Raytech Innovative Solutions, LLC, Sullivan, IN (US)

( * ) Notice: Subject to any disclaimer, the term of this patent is extended or adjusted under 35 U.S.C. 154(b) by 236 days.

(21) Appl. No.: 10/616,514

(22) Filed: Jul. 9, 2003

(65) Prior Publication Data

US 2004/0053562 A1 Mar. 18, 2004

Related U.S. Application Data

(60) Provisional application No. 60/395,433, filed on Jul. 12, 2002.

(51) Int. Cl.[7] ..... B24D 17/00

(52) U.S. Cl. ..... 451/56; 451/285; 451/490

(58) Field of Search ..... 451/41, 56, 490, 451/285–290, 302, 307, 502, 512, 526, 530

(56) References Cited

U.S. PATENT DOCUMENTS

| | | | | | |
|---|---|---|---|---|---|
| 3,346,904 | A | * | 10/1967 | Armstrong | 15/230.12 |
| 3,522,681 | A | * | 8/1970 | Lampert | 451/490 |
| 3,823,516 | A | * | 7/1974 | Christian | 451/490 |
| 5,879,227 | A | * | 3/1999 | Martin et al. | 451/356 |
| 5,958,794 | A | | 9/1999 | Bruxvoort et al. | |
| 6,036,586 | A | | 3/2000 | Ward | |
| 6,296,557 | B1 | | 10/2001 | Walker | |
| 6,416,616 | B1 | | 7/2002 | Walker | |
| 6,422,921 | B1 | | 7/2002 | Ettinger | |
| 6,439,970 | B1 | | 8/2002 | Walker | |
| 2004/0127151 | A1 | * | 7/2004 | Takizawa et al. | 451/490 |

* cited by examiner

*Primary Examiner*—Lee D. Wilson
*Assistant Examiner*—Anthony Ojini
(74) *Attorney, Agent, or Firm*—Milton S. Gerstein; Much Shelist Freed

(57) ABSTRACT

The present invention is related to a method for securing a polishing pad to the platen for use in chemical-mechanical polishing. Specifically, a polishing pad is attached to a platen using a reclosable, hook-and-pile fastener, whereby the platen-attachment fastener may be reused. Separate embodiments are disclosed for attaching porous and nonporous polishing pads.

10 Claims, 5 Drawing Sheets

METHOD FOR SECURING A POLISHING PAD TO A PLATEN FOR USE IN CHEMICAL-MECHANICAL POLISHING OF WAFERS

CROSS REFERENCE TO RELATED APPLICATION

Priority of provisional application No. 60/395,433, filed on Jul. 12, 2002, is herewith claimed.

BACKGROUND OF THE INVENTION

The present invention is related to polishing of materials, and in particular to the chemical-mechanical polishing (CMP) of dielectric layers or integrated circuits. Specifically, the present invention is directed to a method of securing a polishing pad to a platen used in the polishing of semiconductor wafers.

In the field of semiconductor manufacture, numerous integrated circuits are produced on round wafers through layers of wiring devices. During the process of forming layers and structures, the topography of the surface becomes increasingly irregular. The prevailing technology for planarizing the surface is chemical-mechanical polishing (CMP). In effect, this process planarizes the top layer of an integrated circuit prior to the depositing of another layer.

In CMP processes, the working layer of an integrated circuit is exposed to a moving polishing pad and a polishing slurry. In some systems, the polishing pad rotates about a fixed axis while the wafer rotates and moves across the pad. Pad properties and the polishing slurry have significant effects on polishing performance. Pads are engineered for specific properties such as stiffness, roughness, compressive modulus, flexural modulus and hydrophilic properties. Polishing slurries are also designed to enhance specific mechanisms during the polishing. These mechanisms are complex; however, in general the slurry contains chemicals that react with the deposited layer on the wafer, abrasives that mechanically cut (micro-machine) the layer, and complexing agents that prevent the removed material from precipitating or re-depositing on the wafer surface.

In most CMP applications, the polishing pad is affixed to a platen by an adhesive layer, typically a pressure sensitive adhesive (PSA). In this configuration, an operator removes the pad by pulling it off the platen, and subsequently cleaning the platen with a solvent, such as isopropyl alcohol. Since typical PSA materials have high peel strength, it can require significant force to overcome the pressure-sensitive-adhesive adhesion, thus increasing the changeover time. In addition, the operator could experience personal injury due to the poor ergonomics of the process, especially if the pad is stiff. Other prior-art systems have attempted to address these issues. U.S. Pat. No. 6,261,958 to Crevasse, et al. describes an apparatus that secures the pad without the use of adhesives by utilizing vacuum or electromagnetic force. U.S. Pat. Nos. 6,036,586 and 6,398,905 of Ward describe an improvement by using a permanent coating of a low-adhesion material such as polytetrafluoroethylene (PTFE). However, these prior-art improvements require either external equipment or modification to the machine and/or platen. Therefore, an improved method for affixing the pad to the platen is desirable.

SUMMARY OF THE INVENTION

It is, therefore, the primary objective to provide a securing layer for releasably, yet strongly, attaching a polishing pad to a CMP platen, which securing layer does not require adhesives, so that the polishing pad may be removed from the platen via the securing layer without undue stress and time.

According to the present invention, the attachment of the polishing pad to the platen is achieved by utilizing a reusable fastening system such as a hook-and-loop combination, or commonly known as a hook-and-pile fastener, or "VELCRO", the required force of removal of which is less than is the prior-art methods using pressure-sensitive adhesives. Thus, quicker changeover times and improved safety are realized. Also, the present invention provides an improved method of attaching porous pads to a platen.

BRIEF DESCRIPTION OF THE DRAWINGS

The invention will be more readily understood with reference to the accompanying drawings, wherein.

DETAILED DESCRIPTION OF THE INVENTION

Figure 1:
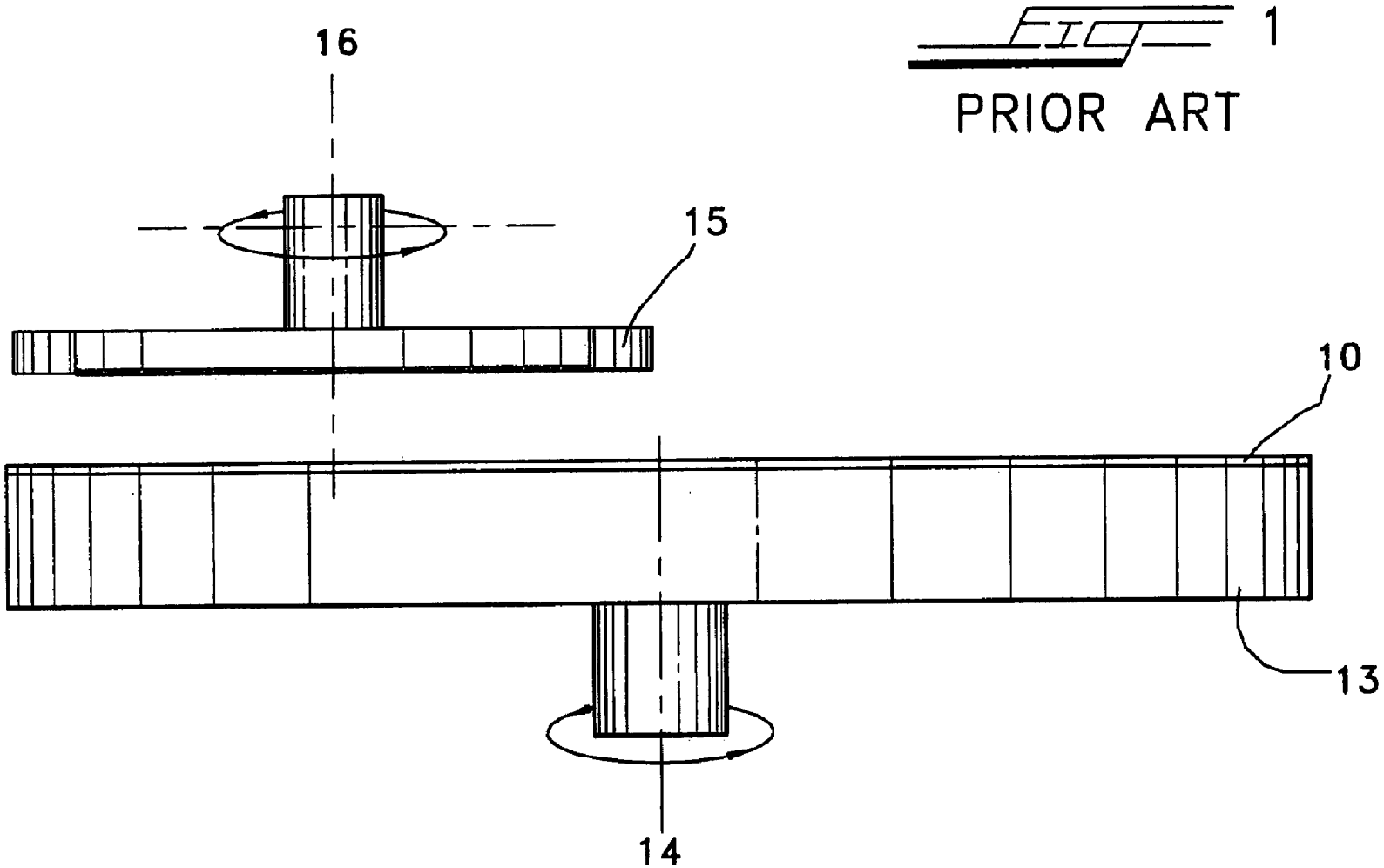
FIG 1 PRIOR ART
FIG. 1 is a plan view showing a conventional, prior-art chemical-mechanical (CMP) process apparatus used in the polishing of semiconductor wafers.

Referring now to the drawings in greater detail, a typical CMP apparatus is shown in FIG. 1. A polishing pad 10 is affixed to a platen 13 that rotates about a fixed axis 14. The wafer to be polished is affixed to a carrier 15 that rotates about a fixed axis 16 which is offset from the platen's fixed axis 14 but which rotates in the same direction. The carrier 15 usually scans the surface of the pad 10 along axis 16 while applying downward pressure on the wafer during polishing. During the polishing process, a polishing slurry is introduced onto the surface of the pad. In some applications, slurry is introduced through the pad from the platen 13.

Figure 2:
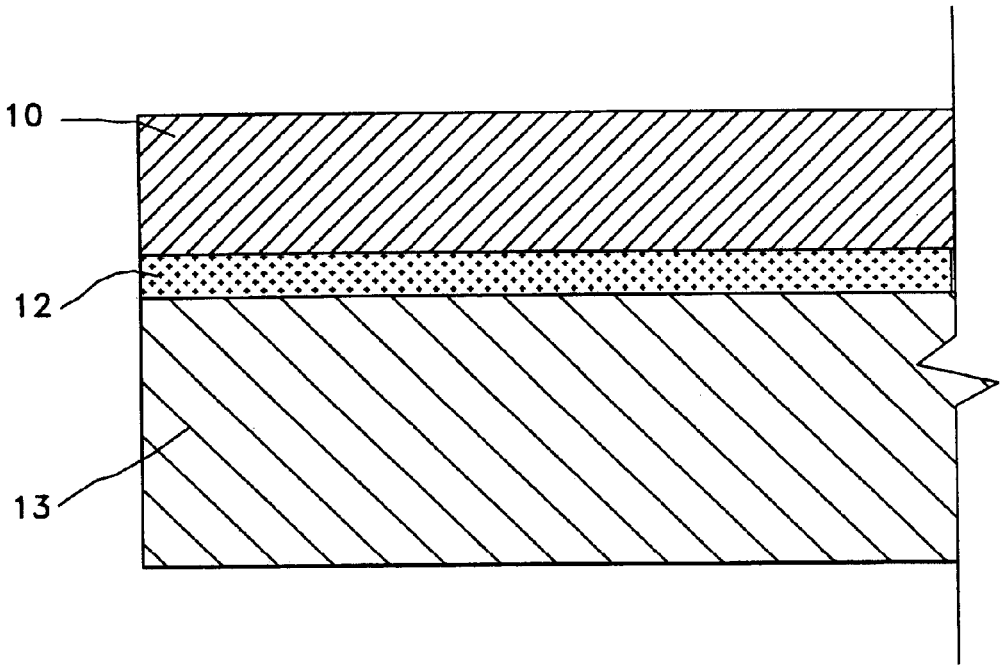
FIG 2 PRIOR ART
FIG. 2 is a cross-sectional view of a conventional, prior-art polishing pad with an adhesive layer securing the pad to a platen.

A typical, prior-art technique for securing polishing pad 10 to the platen 13 is shown in FIG. 2. The polishing pad 10 is attached to the rotating platen 13 via a pressure-sensitive adhesive (PSA) layer 12. Removal of the polishing pad is generally a difficult operation, since typical peel strengths of PSA layers tend to be quite high. As it can be seen from the above-description of the polishing process, the wafer exerts high shear, and moderate compressive, forces on the pad/platen interface. Therefore, PSA layers, which usually have relatively high peel strengths of 0.5–1 N/mm, are not ideally suited for securing the pad to the platen. Also, for use on porous pads, the PSA layer 12 becomes wetted during polishing, which reduces the adhesion of the pad 10 to the adhesive layer 12. Despite these problems, acrylic-based PSA layers are used for their relatively high shear strengths of about 15–40 kPa, and their resistance to water and the chemistry of the polishing process.

According to the present invention, the pad and platen are secured by means of a reclosable fastener having mating hook-and-pile fastening elements, commonly called "VELCRO". The re-closable fasteners used in the present invention have an "A" side (or male side) and "B" side (or female side) that mechanically adjoin when mated together. Moreover, in general, the "A" side has stiff hooks where the "B" side has soft loops, both of which interlock together when joined. Other varieties of re-closable fasteners may be used, such as those where the "A" and "B" sides have similar or identical configurations of mushroom shaped pins. Typical fasteners of both styles tend to exhibit high shear strength, usually in the range of 50–250 kPa, and low peel strength, usually in the range of 0.2–0.6 N/m. Therefore, these fasteners are ideally suited for the high shear and low peel requirements of polishing pads used in CMP apparatuses. In addition, since these fasteners are typically constructed of polyolefin, nylon, polyester or similar polymer, most chemicals used in CMP do not degrade the mechanical interlock.

Figure 3:
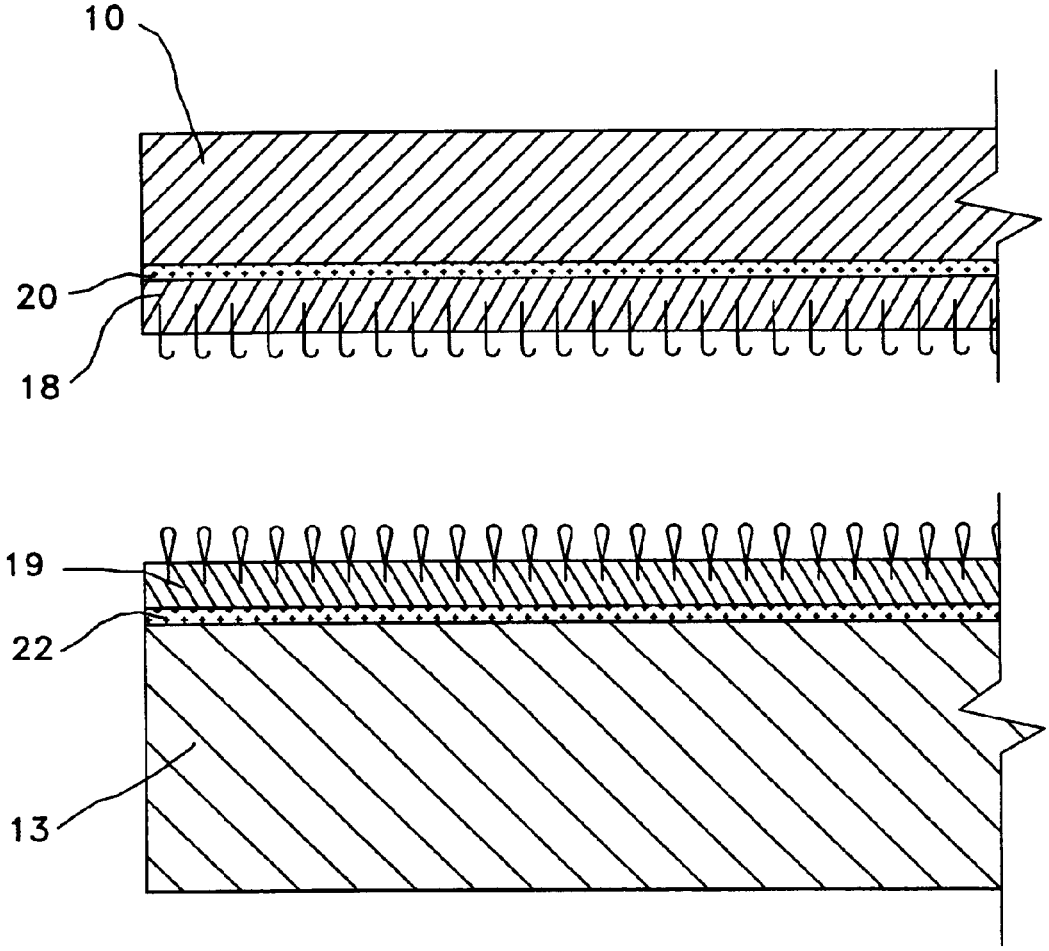
FIG. 3 is a plan view of the first embodiment of the invention where a nonporous polishing pad is secured to a platen of a CMP apparatus via mating hook-and-pile fastening elements.

The first embodiment of the present invention is shown in FIG. 3, which first embodiment is intended for use with a nonporous pad 10. A securing layer has an "A" side 18 shown to be affixed to the pad 10 by an adhesive layer 20, which may be an acrylic PSA. It also has a "B" side 19 shown to be affixed to the platen 13 using a similar adhesive layer 22 which could be also be an acrylic PSA. The "B" side that is affixed to the platen 13 is considered semi-permanent; that is, it does not require replacement for every changeover, but may require replacement if damaged. The "A" side 18 affixed to the pad is changed with every pad by either removing the attached layer and re-applying to a new pad, or using a new "A" side altogether. One variation to this embodiment is where the "A" side is attached to the platen and the "B" side is attached to the pad. In some re-closable fastening systems, the "A" and "B" sides may be identical.

Figure 4:
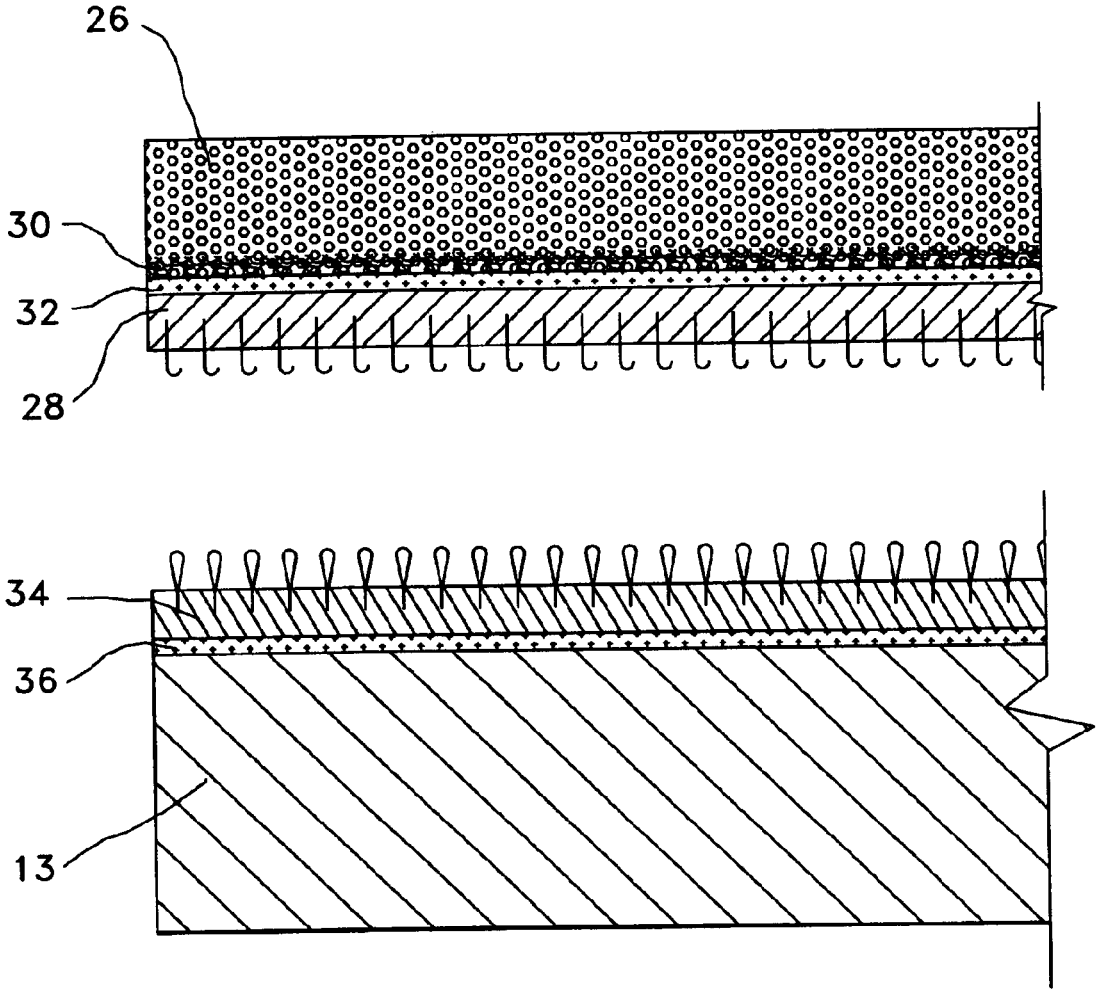
FIG. 4 is a plan view of a second embodiment of the invention where a porous polishing pad is secured to a platen of a CMP apparatus via mating hook-and-pile fastening elements with the addition of a water-sealing adhesive layer to prevent slurry from impinging upon the hook-and-pile fastening elements.

Referring to FIG. 4, there is shown a second embodiment of the invention, which second embodiment is intended for use with a porous polishing pad. An example of such a porous polishing pad is disclosed in commonly-owned, copending application Ser. No. 10/087,223, filed Mar. 1, 2002. In this embodiment, "A" side 28 of the fastener is affixed adhesively by adhesive layer 32 to a thermoplastic boundary layer 30 that is applied to the underside of porous polishing pad 26. Similarly to FIG. 3, the "B" side 34 is attached by an adhesive layer 36 to the platen 13. The boundary layer 30 is created by applying a thermoplastic material in a liquid state to the bottom surface of the pad during manufacture of the polishing pad. The material flows into the porous matrix of the pad and bonds upon solidifying. Such thermoplastic materials may be polyurethane, polyester, nylon, polyolefin, acrylic, polyethylene, polyamide, or derivatives thereof. Also, thermoplastic-based adhesives may be utilized which improve the bonding of the layer to the pad matrix. Such materials include adhesives of polyurethane, polyester, nylon, polyolefin and acrylic. Elastomers may also be used, such as EPDM, Hyalon, natural rubber, silicone, fluorosilicon, Tygon, Viton, and adhesives derived therefrom. The boundary layer 30 may be applied in numerous ways, such as by applying liquid polymer (in either a prepolymer form or a heated state) onto the surface and cooling or curing the polymer. Another method is to melt a thin film of material into the pad matrix. In either case, pressure may be applied to encourage the flow of polymer into the matrix. In one example, a polyurethane-based adhesive film was applied to a porous pad. The film was thermally bonded at about 175 degrees C. into the matrix by applying about 415 kPa on the pad for about ten seconds. The film flowed into the matrix about 0.025–0.050 mm and solidified upon cooling. As such, a boundary layer was created that prevents water-contact with the adhesive layer, to thus provide a water seal to the adhesive layer bonding to the "A" side of the fastener. Moreover, it was found that use of the "A" and "B" hook-and-pile fastener elements actually enhanced performance of the polishing pad as compared with a polishing pad secured by the prior-art PSA layer, by increasing the oxide removal rate by 27%, form 2200 A/min for the polishing pad secured by the prior-art PSA layer as compared with 2800 A/min for the polishing pad secured using the "A" and "B" hook-and-pile fastener elements of the invention.

Figure 5:
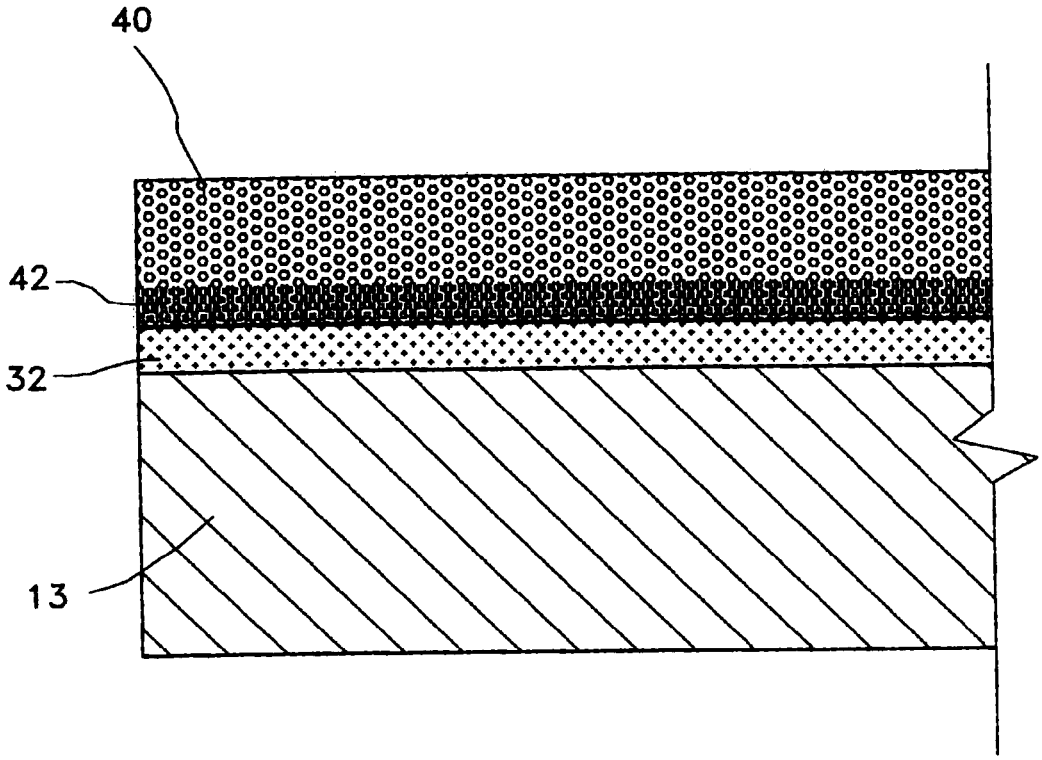
FIG. 5 is a modification of the second embodiment of FIG. 5, showing a porous pad affixed to platen by an adhesive layer, with a thermoplastic boundary layer being provided to prevent the flow of slurry and water onto the adhesive layer.

With regard to the second embodiment of FIG. 4, it is noted that in those applications where the use of the re-securable hook-and-pile fastener elements 28, 34 are not needed or used, a porous polishing pad 40, as seen in FIG. 5, may be secured to a platen 13 by means of an adhesive layer 32 formed with the porous polishing pad 40 by means of thermoplastic boundary layer 42. The thermoplastic boundary layer 42 prevents the flow of slurry and water onto the PSA/pad interface. This effectively prevents the adhesive degradation.

While specific embodiments of the invention have been shown and described, it is to be understood that numerous changes and modifications may be made therein without departing from the scope and spirit of the invention.

What is claimed is:

1. In a CMP apparatus comprising a polishing pad having a working-surface section and a nonworking-surface section, a platen for holding said polishing pad, and means for securing said polishing pad to said platen, the improvement comprising:

said means for securing said polishing pad to said platen comprising hook-and-pile fastening means;

said hook-and-pile fastening means comprising a first portion attached to said polishing pad, and a second portion attached to said platen for mating with said first portion;

said hook-and-pile fastening means having a shear strength in the range of 50–250 kPa, and peel strength in the range of 0.2–0.6 N/m.

2. The CMP apparatus according to claim 1, wherein said polishing pad comprises a nonporous polishing pad;

said means for securing comprising first adhesive means on said nonworking-surface section of said polishing pad for attaching said first portion to said polishing pad, and second adhesive means on said platen for attaching said second portion to said platen.

3. The CMP apparatus according to claim 1, wherein said polishing pad comprises a porous polishing pad;

said polishing pad comprising a thermoplastic boundary layer on said nonworking-surface section of said polishing pad;

said means for securing comprising first adhesive means attached to said thermoplastic boundary layer on said nonworking-surface section of said polishing pad for attaching said first portion to said polishing pad, and second adhesive means on said platen for attaching said second portion to said platen.

4. The CMP apparatus according to claim 1, wherein said hook-and-pile fastening means is made of CMP-non-degradable material.

5. The CMP apparatus according to claim 1, wherein said polishing pad comprises a porous polishing pad;

said nonworking-surface section of said polishing pad comprising a bonding layer fused thereto; said means for securing comprising first adhesive means attached to said bonding layer for attaching said first portion to said polishing pad, and second adhesive means on said platen for attaching said second portion to said platen.

6. The CMP apparatus according to claim 5, wherein said bonding layer is made of a water-impervious material in order to prevent CMP slurry from contacting said first and second adhesive means, having a thickness of between 0.025–0.050 mm.

7. The CMP apparatus according to claim 1, wherein said first portion of said hook-and-pile fastening means comprises the hook-portion thereof having hooks, and said second portion of said hook-and-pile fastening means comprises the pile-portion thereof having loops; said hooks of said hook-portion of said hook-and-pile fastening means being relatively stiff, and said loops of said pile-portion of said hook-and-pile fastening means being relatively soft.

8. A method of securing a polishing pad to a platen of a CMP apparatus, the polishing pad having a working-surface section and a nonworking-surface section, the polishing pad comprising a first portion of a hook-and-pile fastening means attached to the nonworking-surface section, and the platen comprising a pad-supporting surface having a second, mating portion of the hook-and-pile fastening means, said method comprising:

(a) removably attaching the nonworking-surface section of the polishing pad to the pad-supporting surface of the platen with hook-and-pile fastening means having a shear strength in the range of 50–250 kPa, and peel strength in the range of 0.2–0.6 N/m.;

(b) said step of removably attaching comprising attaching the first portion of the hook-and-pile fastening means to the second portion of the hook-and-pile fastening means.

9. The method of securing a polishing pad to a platen of a CMP apparatus according to claim 8, further comprising:

(c) after said step of removably attaching, removing the polishing pad from the platen when the polishing pad has become worn;

(d) said step of removing the polishing pad comprising peeling the first portion of the hook-and-pile fastening means from the second portion of the hook-and-pile fastening means.

10. The method of securing a polishing pad to a platen of a CMP apparatus according to claim 9, further comprising:

(e) removably attaching the nonworking-surface section of another, new said polishing pad to the pad-supporting surface of the platen;

(f) said step of removably attaching the nonworking-surface section of another, new said polishing pad comprising attaching the first portion of the hook-and-pile fastening means of the nonworking-surface section thereof to said second portion of the hook-and-pile fastening means used in said step of attaching the first portion of the hook-and-pile fastening means to the second portion of the hook-and-pile fastening means.

* * * * *